US011300927B2

(12) United States Patent
Wiederrecht et al.

(10) Patent No.: US 11,300,927 B2
(45) Date of Patent: Apr. 12, 2022

(54) DISPLAY MECHANISM WITH ZERO RESET FUNCTION

(71) Applicant: NOGERAH SA, Meyrin (CH)

(72) Inventors: Jean-Marc Wiederrecht, Bernex (CH); Laurent Wiederrecht, Onex (CH); Maximilien Di Blasi, St-Genis Pouilly (FR); Guy Dubois-Ferrière, St-Cergues (FR)

(73) Assignee: NOGERAH SA, Meyrin (CH)

( * ) Notice: Subject to any disclaimer, the term of this patent is extended or adjusted under 35 U.S.C. 154(b) by 430 days.

(21) Appl. No.: 16/461,020

(22) PCT Filed: Nov. 17, 2017

(86) PCT No.: PCT/EP2017/079695
§ 371 (c)(1),
(2) Date: May 15, 2019

(87) PCT Pub. No.: WO2018/091696
PCT Pub. Date: May 24, 2018

(65) Prior Publication Data

US 2019/0271948 A1 Sep. 5, 2019

(30) Foreign Application Priority Data

Nov. 17, 2016 (EP) ..... 16199406

(51) Int. Cl.
*G04B 19/02* (2006.01)
*G04B 13/00* (2006.01)
*G04F 7/08* (2006.01)

(52) U.S. Cl.
CPC ..... *G04B 19/025* (2013.01); *G04B 13/003* (2013.01); *G04F 7/0804* (2013.01); *G04F 7/0866* (2013.01); *G04F 7/0871* (2013.01)

(58) Field of Classification Search
CPC ..... G04F 7/08; G04F 7/0804; G04F 7/0823; G04F 7/0828; G04F 7/0866; G04F 7/0871; G04B 19/025; G04B 13/003
See application file for complete search history.

(56) References Cited

U.S. PATENT DOCUMENTS 5,784,342 A 7/1998 Genta
2005/0174888 A1* 8/2005 Forsey ..... G04F 7/0842 368/10

(Continued)

FOREIGN PATENT DOCUMENTS

CH 690630 11/2000
CH 699143 1/2010

(Continued)

*Primary Examiner* — Edwin A. Leon
*Assistant Examiner* — Jason M Collins
(74) *Attorney, Agent, or Firm* — Duane Morris LLP; Gregory M. Lefkowitz; Randall C. Pyles

(57) ABSTRACT

A display mechanism a wheel carrying, constrained to rotate with it, a first wheel and a snail-shaped cam, the mechanism having an active first state in which the first wheel is driven in rotation by a driving wheel and a zero reset second state in which it is no longer driven to allow it to return to a predefined position, associated with a predefined position of the display member, the display mechanism further including a feeler-spindle adapted to cooperate with the perimeter of the cam, the feeler-spindle and the perimeter of the cam being adapted and sized so that the feeler-spindle exerts on the cam, in the second state, a return force having a non-radial component adapted to return the first wheel to its predefined position.

20 Claims, 4 Drawing Sheets

(56) References Cited

U.S. PATENT DOCUMENTS

| | | | | |
|---|---|---|---|---|
| 2005/0249044 | A1 | 11/2005 | Forsey et al. | |
| 2010/0182878 | A1* | 7/2010 | Meis | G04F 7/0876 368/81 |
| 2015/0153712 | A1* | 6/2015 | Peters | G04F 8/00 368/80 |
| 2016/0011568 | A1 | 1/2016 | Heinz | |
| 2016/0124392 | A1* | 5/2016 | Genoud | G04F 7/065 368/102 |

FOREIGN PATENT DOCUMENTS

| | | |
|---|---|---|
| CH | 703361 | 12/2011 |
| CH | 704915 | 11/2012 |
| DE | 40770 | 9/1887 |
| EP | 1953612 | 8/2008 |
| EP | 1978424 | 10/2008 |
| EP | 2241944 | 10/2010 |

* cited by examiner

DISPLAY MECHANISM WITH ZERO RESET FUNCTION

CROSS-REFERENCE TO RELATED APPLICATIONS

This application is a § 371 national stage entry of International Application No. PCT/EP2017/079695, filed Nov. 17, 2017, which claims priority of European National Application No. 16199406.6, filed Nov. 17, 2016, the entire contents of which are incorporated herein by reference.

TECHNICAL FIELD

The present invention relates to the field of clockmaking. It more particularly concerns a display mechanism with a zero reset function, preferably associated with an instantaneous drive system, and a chronograph mechanism equipped with this kind of mechanism and this kind of system.

PRIOR ART

In the field of chronographs, the chronograph seconds wheel is adapted to be able to be driven by the seconds wheel of the movement via a coupling mechanism when the latter is coupled. The chronograph seconds wheel carries the seconds hand of the chronograph. Where the minutes counter hand is concerned, this is driven by a finger carried by the chronograph seconds wheel, which additionally necessitates an intermediate gear wheel in order for the minutes counter hand to turn in the same direction as the seconds hand. The same applies to the relationship between the minutes counter wheel and the hours counter wheel. In some mechanisms, the counter of the hours wheel may be driven directly from the barrel, without passing via the minutes counter. The wheels of the minutes and hours counters are moreover positioned by jumpers to maintain their position when they are not being acted on by their respective driving system.

Also known are instantaneous jump counters in which a cam is mounted on and constrained to rotate with a chronograph seconds wheel. A lever is held bearing against this cam and is connected to a pawl that enables the minutes counter to be driven by one step each time the lever drops. A jumper also positions the hand.

The patent application EP 2241944 A2 shows one example of this kind of construction.

In parallel with this, the counters are each associated with a heart-shaped cam with which a hammer is able to cooperate when resetting the counter to zero in order to return the hands to a predefined position.

To reset the hands to zero it is necessary to coordinate action of the hammers and decoupling the various counter wheels or decoupling the pawl driving the counter when there is one. The adjustment of the proper coordination of these operations and the adjustment of the position of the heart shapes with the positioning jumpers of the various wheels render this operation delicate if a quality result is to be obtained.

An object of the present invention is to propose a new chronograph construction making it possible to avoid the complex adjustments for synchronization of the various elements for the actuation of the hammers.

DISCLOSURE OF THE INVENTION

To achieve the above object, the applicant has in particular developed a display mechanism with a zero reset function that forms a first aspect of the present patent application. That display mechanism is advantageously associated with an instantaneous drive system of particular construction.

The invention also concerns a timepiece movement with a chronograph function employing this kind of display mechanism and a timepiece including this kind of timepiece movement.

Accordingly, the invention concerns a display mechanism, for a timepiece movement, including a wheel for displaying a first unit comprising a shaft intended to carry a member for displaying the first unit and carrying, constrained to rotate with it, a first wheel and a cam comprising at least one snail-shaped portion, the display mechanism being adapted to be able to exhibit an active first state in which the first wheel is intended to have a kinetic connection with a driving wheel of the timepiece movement to be driven in rotation as a function of the first unit to be displayed, and a zero reset second state in which the kinematic connection is neutralized to allow the first wheel to return to a predefined position, associated with a predefined position of the display member, the display mechanism further including a feeler-spindle adapted to cooperate with the perimeter of the cam. The display mechanism is characterized in that the feeler-spindle and the perimeter of the cam are adapted and sized so that the feeler-spindle applies on the cam, in the second state, a return force having a non-radial component adapted to return the first wheel to the predefined position.

According to a preferred embodiment, the feeler-spindle being intended to be mounted to rotate on a frame element of the timepiece movement, the display mechanism may include a spring adapted to act on the feeler-spindle and

- to tend to maintain it bearing against the perimeter of the cam, so that the feeler-spindle is able to be moved between a first position, associated with a minimum radius zone of the cam, and a second position associated with a maximum radius zone of the cam, and
- to contribute at least partially to the application of the return force to the cam via the feeler-spindle, in the second state.

The mechanism may further include an arming wheel constrained to rotate with the feeler-spindle and adapted to be subjected to an additional force, in the second state, having properties such that it contributes to the application of the return force to the cam by the feeler-spindle.

Moreover, the mechanism may preferably include a driving wheel having a kinematic connection to the arming wheel and comprising a drive finger adapted, in the first state, to be able to cooperate with a second wheel, forming part of a second display wheel of a second unit corresponding to a multiple of the first unit, and to drive it by at least one step in response to the passage of the feeler-spindle from its second position to its first position.

Moreover, the mechanism may include a decoupling lever that can be actuated by a user to apply the additional force to the arming wheel by means of the driving wheel.

According to a preferred embodiment of the invention, the mechanism includes a second cam comprising at least one snail-shaped portion constrained to rotate with the second wheel and cooperating with an additional feeler-spindle subjected to the action of an additional spring for causing it to pivot, in the first state, between a first position, associated with a minimum radius zone of the second cam, and a second position, associated with a maximum radius zone of the second cam, and so that the additional feeler-spindle exerts on the second cam, in the second state, a return force having a non-radial component adapted to return the second wheel to a corresponding predefined position.

Moreover, in this case, the additional feeler-spindle may also be fastened to an additional arming wheel having a kinematic connection with an additional driving wheel comprising a driving finger adapted, in the first state, to be able to cooperate with a third wheel, forming part of a third display wheel, a third unit corresponding to a multiple of the second unit, and to drive it by at least one step in response to the passage of the additional feeler-spindle from its second position to its first position.

This display mechanism may advantageously be associated with an instantaneous drive system that may be described as comprising a driving wheel, i.e. the first wheel, intended to supply energy to a driven wheel, in which the driving wheel is fastened to a cam comprising at least one snail-shaped portion. The drive system further comprises:

- a feeler-spindle mounted to pivot about a rotation axis and held bearing against the perimeter of the cam by a first spring, the feeler-spindle being adapted to move between a first position in which it bears on a minimum radius zone of the cam and a second position in which it bears on a maximum radius zone of the cam,
- an arming wheel driven in rotation by the feeler-spindle,
- a driving wheel kinematically connected to the arming wheel and comprising a drive finger adapted to cooperate with the driven wheel to drive it by one step at least during passage of the feeler-spindle from its second position to its first position.

In a preferred embodiment, the invention also concerns a mechanism for displaying chronometered times comprising a first drive system as mentioned hereinabove in which a chronograph seconds wheel forms the driving wheel and a minutes counter wheel forms the driven wheel.

In a preferred embodiment, the invention also comprises a second drive system as mentioned hereinabove in which the minutes counter wheel forms the driving wheel of the second drive system and in which the driven wheel of the second drive system forms an hours counter wheel.

BRIEF DESCRIPTION OF THE DRAWINGS

Other details of the invention will become more clearly apparent on reading the following description given with reference to the appended drawings, in which.

EMBODIMENT OF THE INVENTION

Figure 1:
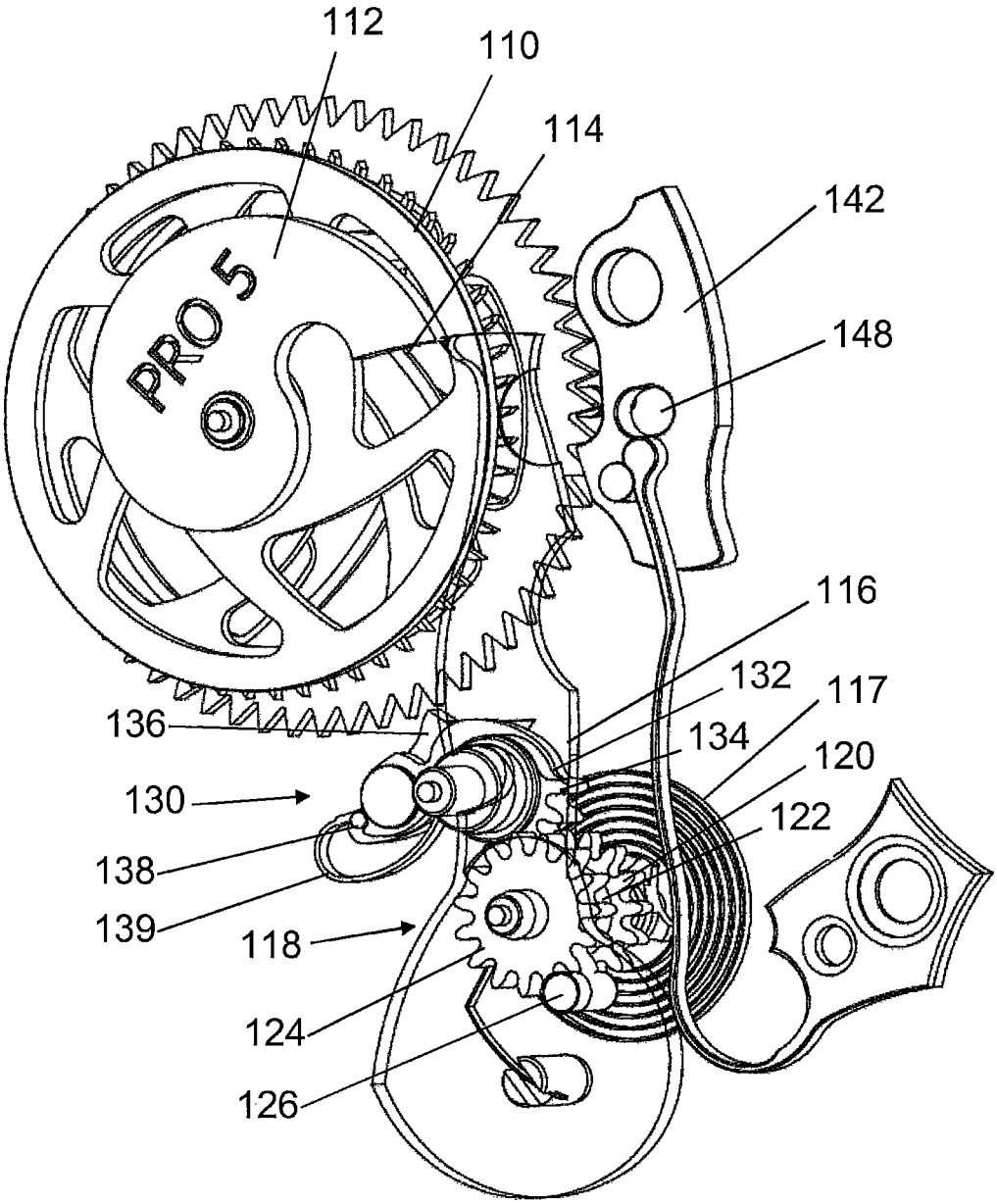
FIGS. 1 and 2 show a first position and a second position of a display mechanism according to the invention employed to drive a minutes counter wheel by means of a chronograph seconds wheel to enable the display of measured times.
Figure 3:
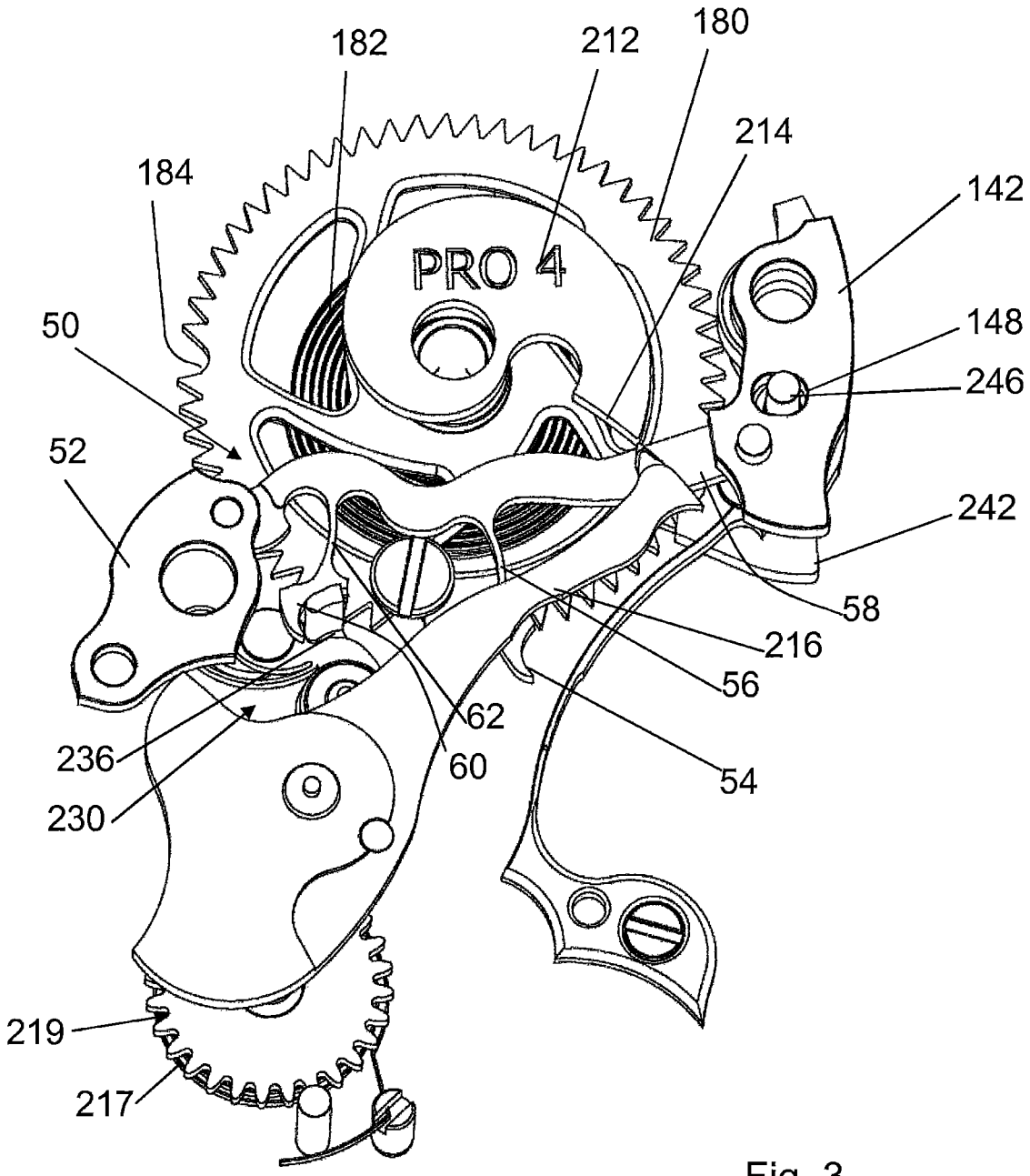
FIGS. 3 and 4 show a first position and a second position of a display mechanism according to the invention employed to drive an hours counter wheel by means of a minutes counter wheel of a chronograph mechanism.
Figure 4:
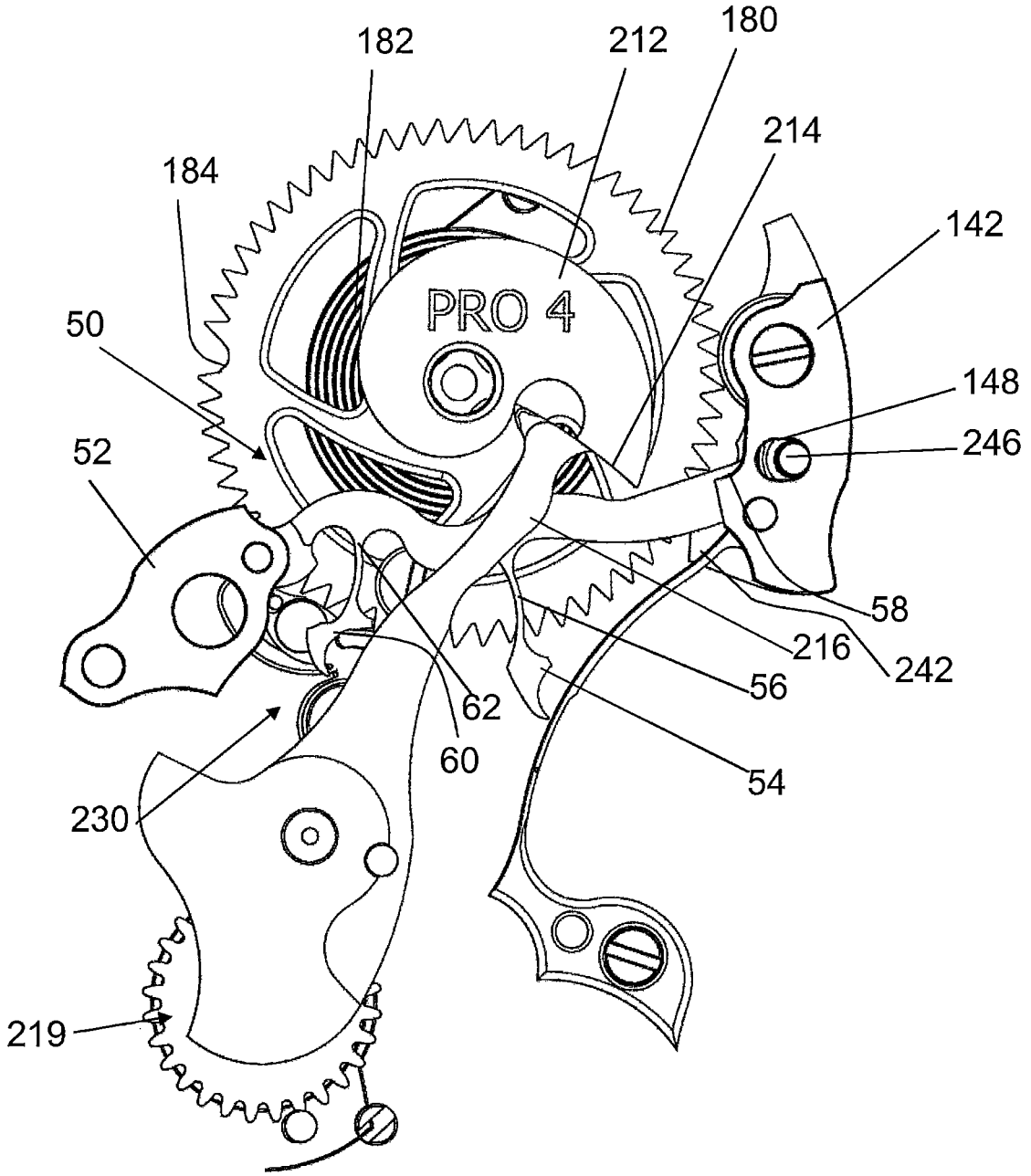

There has been represented in FIG. 1 an instantaneous drive system for a wheel driven by a driving wheel, associated with a display mechanism according to the invention. In the examples described hereinafter, this drive system is employed in a chronograph on the one hand to drive a minutes counter wheel 140 by means of a chronograph seconds wheel 110 (FIGS. 1 and 2) and to drive an hours counter wheel 180 by means of the minutes counter wheel 140 (FIGS. 3 and 4).

In the present description, the identical elements of the drive systems will bear the same tens and units digits and respectively the hundreds digit 1 for the elements involved in driving the minutes counter wheel and the hundreds digit 2 for the elements involved in driving the hours counter.

Accordingly, in FIG. 1, the driving wheel is the chronograph seconds wheel 110 adapted to be coupled to a second wheel in a first operating state by a coupling that is not shown. During phases in which the chronograph is stopped, the chronograph seconds wheel 110 is positioned by a brake, which may be of the conventional type, and is not shown either.

The chronograph seconds wheel 110 is constrained to rotate with a snail-shaped cam 112 the various roles of which will become apparent later. In the example proposed, the cam 112 is of "single" snail shape, but there could also be envisaged having a plurality of snail-shaped portions, distributed at 360°/N, where N is the number of snail-shaped portions. Each snail-shaped portion defines at respective ends a minimum radius zone and a maximum radius zone. In the direction of rotation of the cam, the passage from a minimum radius zone to a maximum radius zone is progressive and the passage from a maximum radius zone to the minimum radius zone is sudden, operating over a fraction of a degree and defining a threshold 114.

A first feeler-spindle 116 is mounted to pivot about a rotation axis and held pressed against the perimeter of the cam by a first spring 117. In the example, the first spring is a spiral spring without this being limiting on the invention. The first feeler-spindle 116 is adapted to evolve between a first position in which it bears on a minimum radius portion of the cam 112 and a second position in which it bears on a maximum radius portion of the cam 112.

According to a feature of particular interest, the snail-shaped cam 112 and the feeler-spindle 116 are adapted and sized so that pressure exerted on the feeler-spindle 116 in the direction of the cam 112 has a non-radial component serving as a return force adapted to drive the cam 112 in rotation in the direction opposite its normal driving by the movement, until the feeler-spindle 116 abuts against the threshold 114 or one of the thresholds of the cam.

The feeler-spindle 116 carries on its rotation shaft an arming wheel 118 constrained to rotate with the feeler-spindle 116. The arming wheel 118 could also be mounted to pivot on another shaft, being driven in rotation by a set of teeth fastened to the feeler-spindle 116.

In the example described the arming wheel 118 comprises a first pinion 120 disposed on and fastened to a shaft 122 coaxial with the rotation axis, on a first side of the feeler-spindle 116. A second pinion 124 is also disposed on and fastened to the shaft 122, on the other side of the feeler-spindle 116 with reference to the first pinion 120. A pin 126 can be fixed to the feeler-spindle 116, in the set of teeth of the second pinion 124, to constrain the arming wheel 118 to rotate with the feeler-spindle. When the pin 126 is not in place the indexing of the arming wheel 118 relative to the feeler-spindle 116 can easily be adjusted. The pin and the second pinion form means for indexing the position of the arming wheel 118 and more particularly of the first pinion 120 with respect to the feeler-spindle 116.

The drive system according to the invention further comprises a driving wheel 130 kinematically connected to the arming wheel 118. According to the example, the driving wheel 130 comprises a plate 132 provided with a set of teeth 134 engaged with the first pinion 120 of the arming wheel 118. The driving wheel 130 also comprises a driving finger 136 adapted to cooperate with the driven wheel (in this instance the minutes counter wheel 140) to drive it. The set of teeth of the driven wheel is provided to optimize the transfer of torque transmitted by the driving finger 136. The latter is mounted to be mobile in rotation on the plate 132, being pressed against an abutment 138 by an elastic member 139. The driving finger 136 is therefore able to drive the driven wheel in the anticlockwise direction with reference to the figures, which are views from the bottom of the movement, i.e. in the clockwise direction on the dial side, the driving finger 136 then bearing against the abutment 138. On the other hand, the finger 136 is retractable, moving against the elastic member 139, to get past the set of teeth of the driven wheel when the driving wheel turns in the anticlockwise direction, i.e. during an arming phase.

Figure 2:
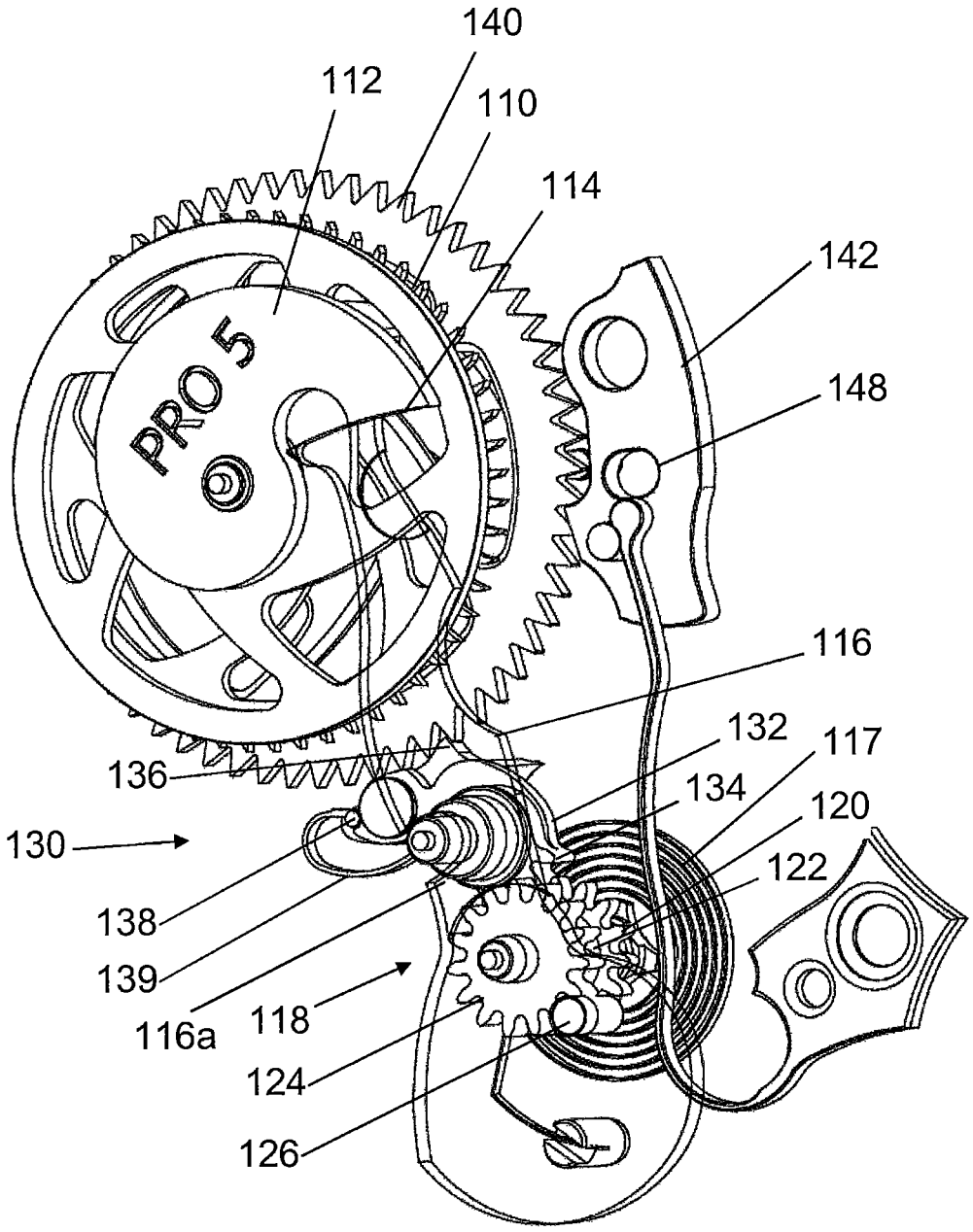

It is therefore clear that on passing from its second position, shown in FIG. 1, to its first position, shown in FIG. 2, the sudden dropping of the feeler-spindle 116 rotates the arming wheel 118 and consequently the driving wheel 130. The driving finger 136 completes a turn around the rotation axis of the driving wheel 130 during which it preferably drives the driven wheel by one step. The person skilled in the art may adapt the penetration and the travel of the driving finger in order to determine the number of steps effected by the driven wheel each time the feeler-spindle 116 drops.

In the embodiment shown by way of example, the cam is fastened to the chronograph seconds wheel 110 and the minutes counter wheel 140 is driven by one step on each rotation of the cam 112, i.e. each minute.

Additionally, it can further be seen in the figures that the feeler-spindle includes a notch 116*a* enabling the rotation shaft of the arming wheel 118 to pass through it during movements of the feeler-spindle.

The angular position of the minutes counter wheel 140 is secured by a safety pawl 142 cooperating directly with its set of teeth.

The chronograph shown in the figures advantageously includes a second drive system for driving an hours counter wheel 180 via the minutes counter wheel 140 (FIGS. 3 and 4). The operation of the second drive system being similar to that of the first, the similar elements will be described more briefly.

Where the second drive system is concerned, the driving wheel is therefore the minutes counter wheel 140, which is also the driven wheel of the first drive system.

The minutes counter wheel 140 is constrained to rotate with a second snail-shaped cam 212. In the proposed example, the cam 212 is of "single" snail shape and includes only one threshold.

A second feeler-spindle 216 is mounted to pivot about a second rotation axis, distinct from the first rotation axis in the example, and held pressed against the perimeter of the second cam 212 by a second spring 217, also a spiral spring in the example. The second feeler-spindle 216 is able to move between a first position in which it bears on a minimum radius portion of the cam and a second position in which it bears on a maximum radius portion of the cam.

The second snail-shaped cam 212 and the second feeler-spindle 216 are sized and arranged so that pressure exerted by the second feeler-spindle 216 in the direction of the second cam 212 has a non-radial component serving as a return force adapted to drive the cam 212 in rotation in the direction opposite its normal driving direction by the movement until the second feeler-spindle 216 abuts against the threshold 214 of the second cam.

The second feeler-spindle 216 carries on its rotation shaft a second arming wheel (not visible, under the feeler-spindle 216) constrained to rotate with the second feeler-spindle 216. A return wheel 219 is continuously engaged with the arming wheel and held in tension by the second spring 217.

The second drive system according to the invention further comprises a second driving wheel 230 kinematically connected to the second arming wheel. The second driving wheel 230 is essentially masked in the figures but is similar to the first driving wheel visible in FIGS. 1 and 2. Thus it includes a retractable second driving finger 236 adapted to cooperate with the second driven wheel to drive it.

The second driven wheel is therefore the hours counter wheel 180 of the chronograph.

It is therefore clear that when it moves from its second position, shown in FIG. 3, to its first position, shown in FIG. 4, the sudden dropping of the second feeler-spindle 216 rotates the second arming wheel and consequently the second driving wheel 230. The second driving finger 236 completes a turn around the rotation axis of the second driving wheel 230 during which it drives the hours counter wheel 180 by one step on each rotation of the cam 212 fastened to the minutes counter wheel 140.

In a highly beneficial manner, the various cams 112, 212 and wheels 110, 140, 180 of the chronograph are disposed coaxially, enabling coaxial display of chronometered time information, i.e. seconds, minutes and hours in the example.

The angular position of the hours counter wheel 180 is also secured by a second safety pawl 242 disposed on the same shaft as the first safety pawl 142. The two safety pawls 142, 242 are interconnected with clearance by a pin 246 accommodated in an oblong hole 148 in the first pawl and in an oblong hole that cannot be seen in the second pawl 242 to enable them to operate separately on their respective wheel.

The drive system according to the invention is particularly advantageous when it is employed in a chronograph, as shown and described in the present application. In fact, as explained hereinafter, in the context of use of the display mechanism according to the present invention, the feeler-spindle of each drive system may also be used to move a counter wheel to a predefined position, i.e. to its zero position here, in the example from FIGS. 1 and 2, the chronograph seconds wheel 110 and, in the example from FIGS. 3 and 4, the minutes counter wheel 140.

As mentioned above, the profile of the cams 112 and 212 is such that its respective feeler-spindle 116, 216 bearing in the direction of the cam enables the cam to be driven in rotation until the feeler-spindle abuts against the step 114, 214 of the snail shape.

Comparison of the shape of the cams of the present invention, on the one hand, and of the cam shown in the patent application EP 2241944 A2 cited above, on the other hand, shows a steeper slope of the perimeter of the cam according to the invention than the usual slope.

Where the zero reset of the chronograph seconds wheel 110 is concerned, the action of the spring 117 is efficient when that wheel 110 is uncoupled and is no longer subjected to a driving torque transmitted by the movement, in a second operating state of the mechanism. In fact, the force exerted by the spring 117 is of course lower than the force driving the movement, for the chronograph to function correctly. Uncoupling may be conventional and need not be described in the present application.

Accordingly, in a zero reset operation, when the chronograph seconds wheel 110 is uncoupled, in the second operating state, the cam 112 is subjected only to the action of the feeler-spindle 116, which returns it to the zero position.

The chronograph mechanism advantageously comprises a decoupling lever 50 adapted to be moved by a zero reset controller 52. The decoupling lever 50 comprises a first functional zone 54 adapted to cooperate with the driving wheel 130. The first functional zone 54 is advantageously disposed at the end of the flexible arm 56, said end being able to include a plurality of levels to reach the driving wheel 130. The additional force exerted by the decoupling lever 50 on the driving wheel 130 advantageously enables an additional torque to be applied to the feeler-spindle 116, against the cam 112, thus accelerating and facilitating the zero reset of the chronograph seconds wheel 110.

The spring 117 can therefore be relatively weak, because the additional force exerted by the user on the zero reset control enables there to be a sufficient torque to zero reset the chronograph seconds wheel 110. The rubbing of the feeler-spindle 116 on the cam 112 therefore disturbs the movement relatively little when the chronograph is operating.

Simultaneously with resetting to zero the seconds counter, the minutes counter wheel 140 must also be reset to zero. The second feeler-spindle 216, subjected to the action of its spring 217, is adapted to cooperate with the second cam 212 and to reset the minutes counter wheel 140 to zero. However, to enable efficient action of the second feeler-spindle 216, it is necessary to decouple the safety pawl 142, which positions the minutes counter wheel 140, and also to decouple the driving wheel 130.

The decoupling lever 50 is shaped to carry out these functions. Firstly, the first functional zone 54 is adapted, by cooperating with the driving wheel 130, to extract the driving finger 136 from the teeth of the minutes counter wheel 140. The decoupling lever 50 also comprises a rigid second functional zone 58 adapted to cooperate with the safety pawl 142 and to extract it from the teeth of the minutes counter wheel 140. The latter is then free to be zero reset by the action of the second feeler-spindle 216.

The action of the second feeler-spindle 216 is also reinforced by actuation of the zero reset controller 52. To this end, the decoupling lever 50 comprises a third functional zone 60 adapted to cooperate with the second driving wheel 230. The third functional zone 60 is advantageously disposed at the end of an additional flexible arm 62, said end being able to include a plurality of levels to reach the second driving wheel 230. The additional force exerted by the decoupling lever 50 on the second driving wheel 230 advantageously enables an additional torque to be imparted to the second feeler-spindle 216, against the second cam 212, thus accelerating and facilitating the zero reset of the minutes counter wheel 140.

The spring 217 can therefore be relatively weak, because the additional force exerted by the user on the zero reset controller makes it possible to have a sufficient torque to zero reset the minutes counter wheel 140. The rubbing of the feeler-spindle 216 on the cam 212 therefore disturbs little the movement during the operation of the chronograph.

Simultaneously with the zero reset of the seconds counter wheel 110 and of the minutes counter wheel 140, the hours counter wheel 180 must also be zero reset. As emerges from the above description, the hours counter wheel 180 is not fastened to a cam that could reset it to zero.

The hours counter wheel 180 is associated with a return spring 182, here taking the form of a spiral spring, adapted to return the wheel to its initial position, which may be defined by an abutment. It will be noted that the hours counter wheel 180 is adapted to effect a maximum rotation of 360°. In fact it includes a truncated tooth 184 preventing the second driving finger 236 from causing it to advance when the truncated tooth 184 arrives opposite the second driving wheel 230.

For zero reset, the second functional zone 58 of the decoupling lever 50 enables simultaneous and synchronized action on the two safety pawls 142 and 242, which are connected to one another by a pin 246 and the two oblong holes. When the decoupling lever 50 frees the hours counter wheel 180 from the second safety pawl 242, the return spring 182 therefore returns it to its initial zero position.

Thus the present application proposes an original jumping drive system particularly suitable for a chronograph mechanism, in which the feeler-spindle enables both connection of the driving wheel to the driven wheel for driving the latter and also participation in the zero reset of the counter, through cooperating with its cam. This avoids recourse to the conventional hammers and heart-shaped cams.

The person skilled in the art will be able to imagine variants stemming from the present description, given by way of nonlimiting example, the scope of the protection being delimited by the claims. It will particularly be noted that, based on the teaching offered hereinabove, the person skilled in the art will be able to propose a chronograph in which the various counters are not coaxial, by adapting the shape of the feeler-spindles and the arrangement of the arming and driving wheels. The shape of the decoupling lever will be adapted in a corresponding manner.

What is claimed is:

1. A display mechanism, for a timepiece movement, including a display wheel for displaying a first unit comprising a shaft intended to carry a display member for displaying said first unit and carrying, constrained to rotate with it, a first wheel and a cam comprising at least one snail-shaped portion, the display mechanism being adapted to be able to display an active first state in which said first wheel is intended to have a kinetic connection with a driving wheel of the timepiece movement to be driven in rotation as a function of said first unit to be displayed, and a zero reset second state in which the kinematic connection is neutralized to allow said first wheel to return to a predefined position, associated with a predefined position of the display member, the display mechanism further including a feeler-spindle adapted to cooperate with a perimeter of said cam, wherein said feeler-spindle is held pressed against the periphery of said cam in said first state, and said feeler-spindle and the perimeter of said cam are adapted and sized so that said feeler-spindle exerts on said cam, in said second state, a return force having a non-radial component adapted to return said first wheel to said predefined position.

2. The mechanism as claimed in claim 1, said feeler-spindle being intended to be mounted to rotate on a frame element of the timepiece movement, wherein it includes a spring adapted to act on said feeler-spindle and to tend to maintain it bearing against the perimeter of said cam, so that said feeler-spindle is able to be moved between a first position, associated with a minimum radius zone of said cam, and a second position associated with a maximum radius zone of said cam, and to contribute at least partially to the application of said return force to said cam by said feeler-spindle in said second state.

3. The mechanism as claimed in claim 2, wherein it includes an arming wheel constrained to rotate with said feeler-spindle and adapted to be subjected to an additional force, in said second state, having properties such that it contributes to the application of said return force to said cam by said feeler-spindle.

4. The mechanism as claimed in claim 3, wherein it further includes a driving wheel having a kinematic connection to said arming wheel and comprising a drive finger adapted, in said first state, to be able to cooperate with a second wheel, forming part of a second display wheel of a second unit corresponding to a multiple of said first unit, and to drive it by at least one step in response to the passage of said feeler-spindle from its second position to its first position.

5. The mechanism as claimed in claim 4, wherein it includes a decoupling lever that can be actuated by a user to apply said additional force to said arming wheel by means of said driving wheel.

6. The mechanism as claimed in claim 5, wherein it includes a safety pawl adapted to cooperate with said second wheel to secure it angularly and wherein said decoupling lever is also adapted to momentarily neutralize said safety pawl in response to an action of a user.

7. The mechanism as claimed in claim 6, wherein it includes a second cam comprising at least one snail-shaped portion constrained to rotate with said second wheel and cooperating with an additional feeler-spindle subjected to the action of an additional spring for causing it to pivot, in said first state, between a first position, associated with a minimum radius zone of said second cam, and a second position, associated with a maximum radius zone of said second cam, and so that said additional feeler-spindle exerts on said second cam, in said second state, a return force having a non-radial component adapted to return said second wheel to a corresponding predefined position.

8. The mechanism as claimed in claim 5, wherein it includes a second cam comprising at least one snail-shaped portion constrained to rotate with said second wheel and cooperating with an additional feeler-spindle subjected to the action of an additional spring for causing it to pivot, in said first state, between a first position, associated with a minimum radius zone of said second cam, and a second position, associated with a maximum radius zone of said second cam, and so that said additional feeler-spindle exerts on said second cam, in said second state, a return force having a non-radial component adapted to return said second wheel to a corresponding predefined position.

9. The mechanism as claimed in claim 4, wherein it includes a second cam comprising at least one snail-shaped portion constrained to rotate with said second wheel and cooperating with an additional feeler-spindle subjected to the action of an additional spring for causing it to pivot, in said first state, between a first position, associated with a minimum radius zone of said second cam, and a second position, associated with a maximum radius zone of said second cam, and so that said additional feeler-spindle exerts on said second cam, in said second state, a return force having a non-radial component adapted to return said second wheel to a corresponding predefined position.

10. The mechanism as claimed in claim 9, wherein said additional feeler-spindle is fastened to an additional arming wheel having a kinematic connection with an additional driving wheel comprising a driving finger adapted, in said first state, to be able to cooperate with a third wheel, forming part of a third display wheel of a third unit corresponding to a multiple of said second unit, and to drive it by at least one step in response to the passage of said additional feeler-spindle from its second position to its first position.

11. The mechanism as claimed in claim 10, wherein it is adapted to enable the display of chronometered times, said first, second and third display wheels being intended to enable the display of the seconds, minutes and hours of chronometered times, respectively.

12. A timepiece movement including a mechanism as claimed in claim 11.

13. A timepiece including a timepiece movement as claimed in claim 12.

14. The mechanism as claimed in claim 9, including a decoupling lever that can be actuated by a user to apply said additional force to said arming wheel by means of said driving wheel, wherein said decoupling lever is also adapted to apply an additional force to said additional arming wheel, in said second state, having properties such that said additional force contributes to the application of said return force to said second cam by said additional feeler-spindle.

15. The mechanism as claimed in claim 14, wherein it is adapted to enable the display of chronometered times, said first, second and third display wheels being intended to enable the display of the seconds, minutes and hours of chronometered times, respectively.

16. The mechanism as claimed in claim 9, wherein it is adapted to enable the display of chronometered times, said first display wheel being intended to enable the display of seconds, respectively minutes, of chronometered times and the second display wheel being intended to enable the display of the minutes, respectively the hours, of chronometered times.

17. The mechanism as claimed in claim 4, wherein it is adapted to enable the display of chronometered times, said first display wheel being intended to enable the display of seconds, respectively minutes, of chronometered times and the second display wheel being intended to enable the display of the minutes, respectively the hours, of chronometered times.

18. A timepiece movement including a mechanism as claimed in claim 1.

19. A timepiece including a timepiece movement as claimed in claim 18.

20. The timepiece claimed in claim 19, wherein it comprises a chronograph mechanism associated with respective coaxial displays of the chronometered time units intended to be displayed.

* * * * *